United States Patent [19]

Homan

[11] Patent Number: 4,802,622

[45] Date of Patent: Feb. 7, 1989

[54] SINGLE TRACK MOBILE STORAGE STRUCTURE AND METHOD

[75] Inventor: John F. Homan, Brighton, Mich.

[73] Assignee: Homan Company, Inc., Brighton, Mich.

[21] Appl. No.: 866,465

[22] Filed: May 22, 1986

[51] Int. Cl.[4] ..... A47B 53/00; A47B 96/00

[52] U.S. Cl. ..... 238/10 R; 312/201; 104/118; 104/245

[58] Field of Search ..... 238/10 R, 1; 312/201, 312/200, 199, 198; 104/172.3, 245, 118, 243, 307, 242; 105/141; 33/287

[56] References Cited

U.S. PATENT DOCUMENTS

| | | | |
|---|---|---|---|
| 2,045,756 | 6/1936 | Cone | 312/201 |
| 3,286,651 | 11/1966 | Dahl, Jr. | 104/118 X |
| 3,563,180 | 2/1971 | Rutledge | 104/245 X |
| 3,923,354 | 12/1975 | Young | 312/199 X |
| 3,967,868 | 7/1976 | Baker, Jr. | 312/201 |
| 4,305,335 | 12/1981 | Plugge | 104/172.3 |
| 4,417,524 | 11/1983 | Quinn et al. | 312/198 X |
| 4,597,615 | 7/1986 | Steger | 312/201 |

FOREIGN PATENT DOCUMENTS

| | | | |
|---|---|---|---|
| 0222834 | 8/1962 | Austria | 312/201 |
| 0696130 | 10/1964 | Canada | 312/199 |
| 0866205 | 4/1961 | United Kingdom | 312/201 |

*Primary Examiner*—Robert B. Reeves
*Assistant Examiner*—Scott H. Werny
*Attorney, Agent, or Firm*—Dale R. Small & Assoc.

[57] ABSTRACT

A compact mobile storage system structure and method. The structure includes a sigle track having rail and guide portions for each row of separate storage units and structure for compensating for drift of the individual storage units including adjusting screws for effecting leveling of the single track or varying the slope of the single track. The structure of the invention further includes annular lubricating members in recesses on each side of rotatably mounted wheels on the individual storage units. The method of the invention includes guiding the individual units of a compact mobile storage system along a single track at one edge of the storage units and compensating for drift of the individual units by adjusting the slope of the single track so that it is opposite the slope of the floor at the opposite edge of the individual storage units.

8 Claims, 3 Drawing Sheets

SINGLE TRACK MOBILE STORAGE STRUCTURE AND METHOD

BACKGROUND OF THE INVENTION

1. Field of the Invention

The invention relates to compact mobile storage systems, and refers more specifically to a single track compact mobile storage system including drift compensation, which is simple in concept, easy to manufacture, and efficient in use.

2. Description of the Prior Art

Mobile storage systems and methods have been known in the past.

Many such systems include two spaced apart tracks positioned on a floor in which rollers, on which storage units are supported, are positioned to permit movement of the storage units along the tracks. Such dual track units have the disadvantage of requiring installation of two separate tracks, with the added cost of the second track and the added inconvenience of the second track in providing a tripping hazard and impeding cleaning.

With most currently available mobile storage systems, careful installation and levelling of the spaced apart tracks is essential to prevent drift of the storage units positioned thereon due to irregularities of the floor on which the mobile storage systems are installed. One such double track mobile storage system available provides flexible tracks with no levelling. Such units are cheaper, but have the disadvantage of permitting undesirable drift of the individual storage units.

Another currently available mobile storage system provides overhead tracks for guiding the separate storage units. Such a system is again a double track system, and does not compensate for drift of the individual storage units due to floor irregularities.

No single track mobile storage structures or methods are known. Similarly, no mobile storage systems including drift compensation are known. Thus it is believed that there are no existing available single track mobile storage systems which include drift compensation.

SUMMARY OF THE INVENTION

In accordance with the present invention, a single track compact mobile storage structure and method is provided. The structure and method of the invention includes means for and the step of compensating the mobile storage system for drift of individual storage units.

In accordance with the structure of the invention, each row of individual mobile storage units is operable in conjunction with a single track assembly including a rail portion and a guide portion with which wheel assemblies and guide assemblies on the individual storage units are associated. In addition, each mobile storage unit includes wheels on the side thereof opposite the track for supporting the mobile storage unit directly on a floor. The wheels of the mobile storage units may take different configurations in accordance with the load to be supported on the mobile storage units and may include annular lubricating structure in conjunction therewith.

In accordance with the method of the invention, the base of the mobile storage units is sufficiently flexible so as to be articulated under design loads. Further, the single track of the mobile storage system of the invention is varied in elevation with respect to the floor on which it is installed in a direction opposite the slope of the floor engaged by the wheels on the opposite side of the mobile storage units to provide compensation for drift of the individual mobile storage units in installation. Alternatively, the single track of the mobile storage system of the invention may be levelled to provide compensation for drift.

DESCRIPTION OF THE PREFERRED EMBODIMENT

Figure 1:
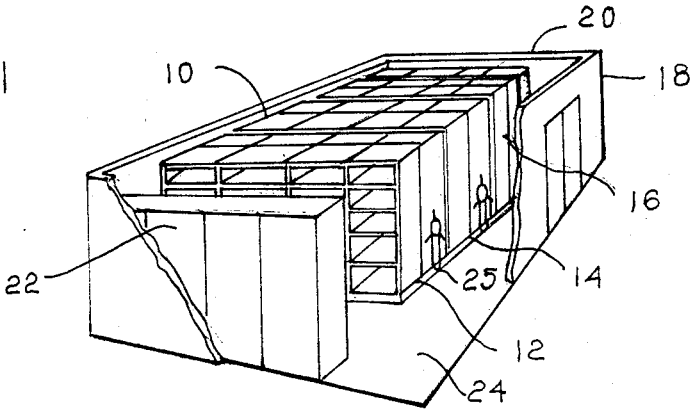
FIG. 1 is a perspective view of a room including mobile storage units constructed in accordance with the invention for practicing the method of the invention installed therein.

In one embodiment, the compact mobile storage system 10 of the invention as best shown in FIG. 1 includes a plurality of separate storage units such as units 12, 14, and 16, which may be installed in a room 18 together with, for example, fixed end storage units 20 and 22. For clarity's sake, the ceiling of the room as shown in FIG. 1 is missing, and the walls are partly broken away.

Figure 2:
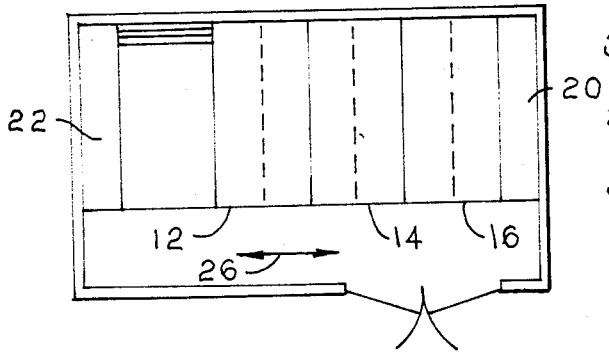
FIG. 2 is a plan view of the room and mobile storage units illustrated in FIG. 1.

As shown best in FIG. 2, the individual mobile storage units 12, 14, and 16 may be individually moved in the direction of arrow 26 to provide an aisle 28 between any two of the individual storage units such as units 14 and 16. The ability to move the units 12, 14, and 16 as shown in FIG. 2 so as to place the aisle 28 in any desired location between any two of the mobile storage units 12, 14, and 16, or between the units 16 or 12 and the fixed, end storage units 20 or 22 respectively, provides a much greater storage area in a room 18 than would be possible with separate fixed position storage units.

Figure 3:
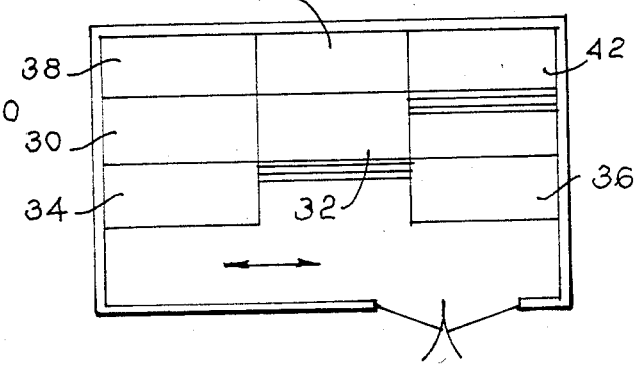
FIG. 3 is a plan view of the room illustrated in FIG. 1, showing laterally movable mobile storage units constructed in accordance with the invention installed therein.

Alternatively, as shown best in FIG. 3, the storage units 12, 14, 16, 20, and 22 may be replaced by fixed storage units 38, 40, and 42, and laterally movable storage units 30, 32, 34, and 36. In the embodiment of the invention shown in FIG. 3, the movable individual storage units 30, 32, 34, and 36 are movable to provide access to the fixed storage units 38, 40, and 42, and the movable storage units 30 and 32, as desired.

Figure 4:
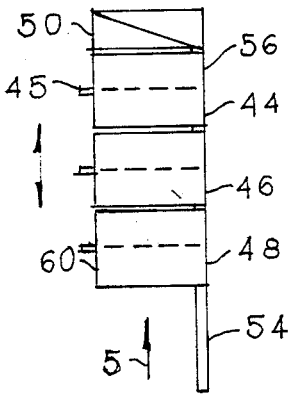
FIG. 4 is a plan view of a single track mobile storage system constructed in accordance with the invention showing a single row of separate storage units.
Figure 5:
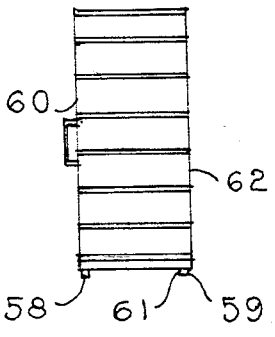
FIG. 5 is an elevation view of the single track mobile storage system illustrated in FIG. 4, taken in the direction of arrow 5 in FIG. 4.
Figure 7:
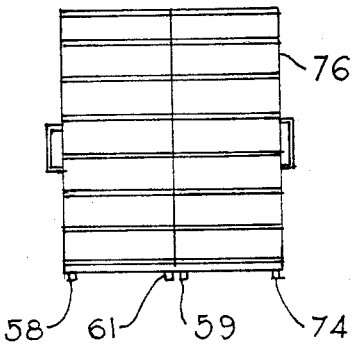
FIG. 7 is an elevation view of the mobile storage system illustrated in FIG. 6, taken in the direction of arrow 7 in FIG. 6.
Figure 9:
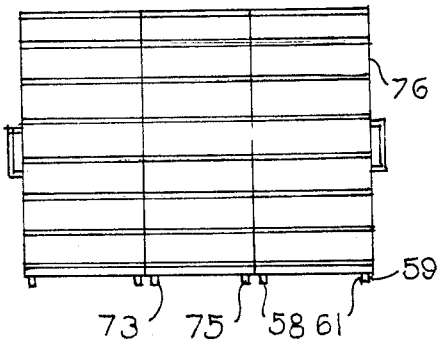
FIG. 9 is an elevation view of the mobile storage system illustrated in FIG. 8, taken substantially in the direction of arrow 9 in FIG. 8.

In accordance with the invention, the compact mobile storage system of the invention may be constructed of a single row of separate storage units 44, 46, and 48 in conjunction with a single fixed storage unit 50, which as shown in FIG. 4 is half as deep as the two-sided movable storage units 44, 46, and 48. The storage units 44, 46, and 48 are guided in their movement in the direction of arrows 52 by a single track 54 positioned along one edge 62 of the separate storage units 44, 46, and 48 in conjunction with wheel and guide assemblies 59 and 61 on the storage units at the edge 62 thereof. Wheel assemblies 58 are also provided at the other edge 60 of the individual storage units 44, 46, and 48, as shown best in FIG. 5, and are supported directly on the floor.

Figure 6:
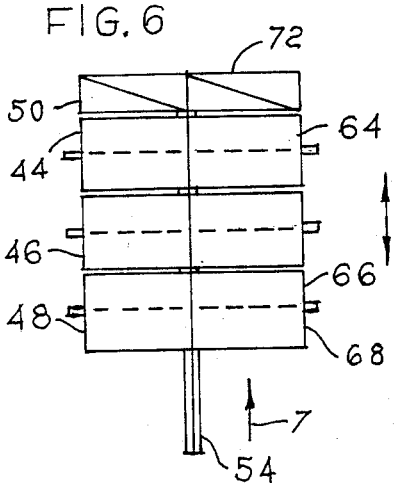
FIG. 6 is a plan view of a double unit, single track mobile storage system constructed in accordance with the invention for practicing the method of the invention and having the single track substantially centrally located between the storage units.

Alternatively, if desired, a second row of storage units 64, 66, and 68 are secured to storage units 44, 46, and 48 and are guided along the track 54 in the direction of arrows 70, as shown best in FIG. 6. In the FIG. 6 embodiment, a separate fixed storage unit 72 is also provided as shown. Again, floor supported wheel assemblies 74 are provided at the outer edge 76 of the individual movable storage units 64, 66, and 68. Thus, double storage units are provided in the FIG. 6 embodiment of the invention with the single track being provided substantially centrally therebetween.

Figure 8:
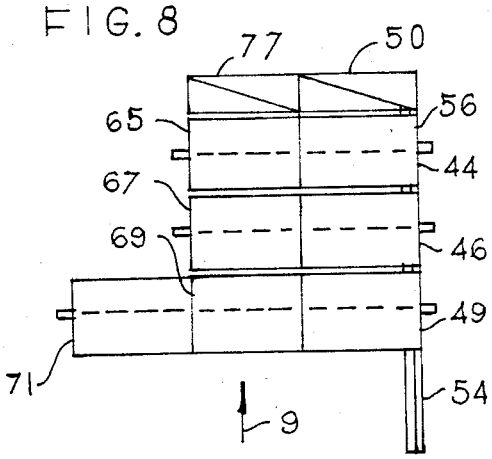
FIG. 8 is a plan view of a multiple unit single track mobile storage system constructed in accordance with the invention for practicing the method of the invention and having the single track at one end of the storage units.

In the FIG. 8 embodiment of the invention, a second row of storage units 65, 67, and 69 are secured to the other end of the storage units 44, 46, and 48, and are guided by track 54 through storage units 44, 46, and 48. Additional storage units such as unit 71 may be secured to storage units 65, 67, and/or 69 as desired. Each storage unit 65, 67, 69, and 71 must be provided with wheel assemblies 73 and 75 supported directly on the floor at both ends thereof. Accordingly, double or multiple storage units are provided in the FIG. 8 embodiment with the single track being at one end of the connected double or multiple storage units. As desired, additional fixed storage units 77 may be provided in the FIG. 8 embodiment of the invention.

Figures 10, 11:
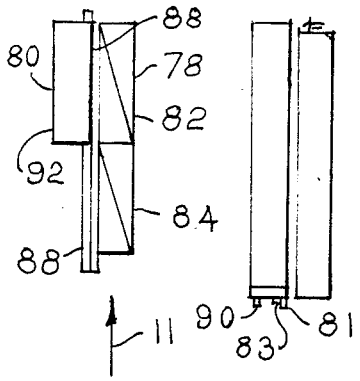
FIG. 10 is a plan view of a single track mobile storage system constructed in accordance with the invention for practicing the method of the invention and showing a laterally movable separate storage unit.
FIG. 11 is an elevation view of the mobile storage system illustrated in FIG. 10, taken substantially in the direction of arrow 11 in FIG. 10.

In the structure 78, shown in FIG. 10, the laterally movable single storage unit 80 is provided in front of two fixed storage units 82 and 84. The laterally movable storage unit 80 is again guided on a single track 86 positioned on the floor adjacent the one edge 88 of the movable storage unit 80 in conjunction with wheel assemblies 81 and guide assemblies 83. Wheel assemblies 90, as shown best in FIG. 11, are provided at the other edge 92 of the movable storage unit 80. It will be understood that a plurality of separate laterally movable storage units such as shown in FIG. 3 may be provided along with the movable storage unit 80, illustrated in FIG. 10.

Figure 13:
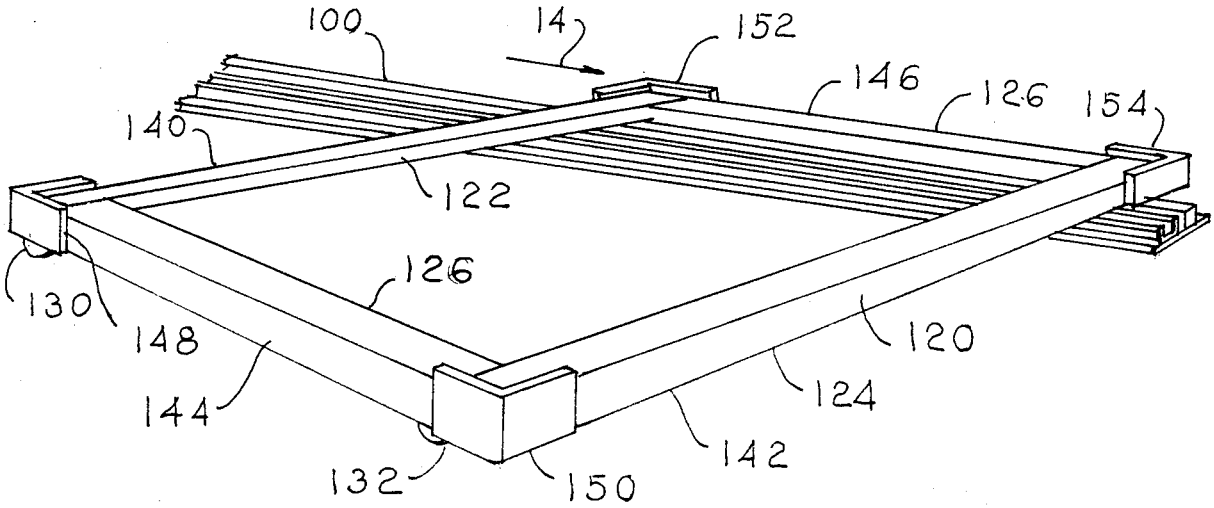
FIG. 13 is a perspective view of the single track and carriage of the mobile storage units constructed in accordance with the invention for practicing the method of the invention.
Figure 14:
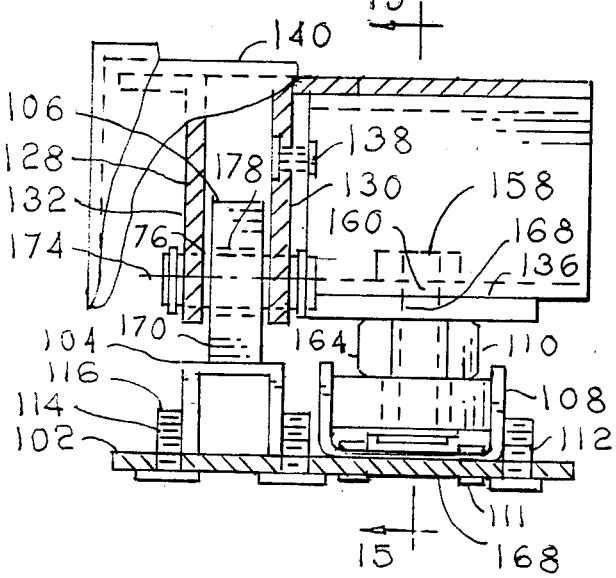
FIG. 14 is a partly, broken away, enlarged elevation view of a portion of the carriage and track structure illustrated in FIG. 13, taken in the direction of arrow 14 in FIG. 13.
Figure 15:
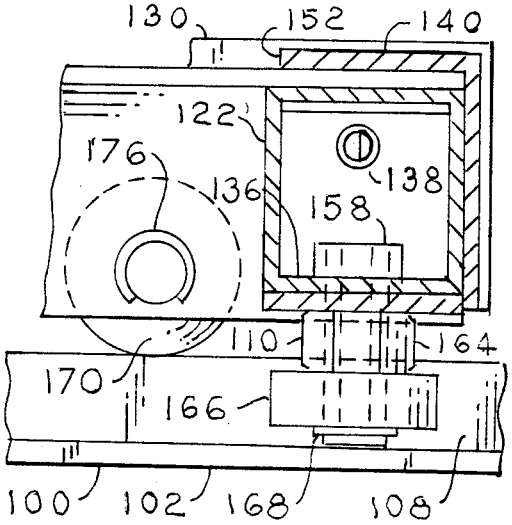
FIG. 15 is a section view of the structure illustrated in FIG. 14, taken substantially on the line 15—15 in FIG. 14.

More specifically, as shown best in FIGS. 13, 14, and 15, the single track 100 includes an elongated, substantially flat base member 102. An elongated rail 104, which as shown in an inverted channel, may be secured to the base member 102 by convenient means such as welding. Alternatively, the rail 104 may be a solid elongated rail secured to the base member 102 by convenient means such as screws, not shown. The rail 104 supports the weight of one end of the individual storage units through wheel asasemblies 106 which roll thereon.

The track 100 further includes a guide channel 108, extending longitudinally thereof and opening upwardly, as shown best in FIG. 14. The guide channel 108 may be secured to the base member 102 of the track 100 by convenient means such as rivets 11, welding, or the like. Guide channel 108 receives and guides the guide assembly 110.

The base member 102 of the track 100 may be adjusted vertically by means of adjusting screws 112, positioned in spaced apart relation along the length of the base member 102. In this regard, the adjusting screws 112 are threaded, the openings 114 through the base member 102 of the track 100 are also threaded, and the upper ends 116 of the adjusting screws 112 are provided with convenient means such as a screwdriver slot or an allen wrench recess to permit turning of the adjusting screws to accurately position the height of the base member 102 as desired. The base member 102 is grouted in place after adjustment to complete the installation thereof.

Each of the individual storage units of the mobile storage system of the invention includes a carriage or base 120, as shown best in FIG. 13. The carriage 120 is substantially rectangular and includes parallel, transversely spaced apart side members 122 and 124, which are generally rectangular in cross section, as shown best in FIG. 15. The carriage 120 further includes parallel, spaced apart end members 126 and 128 constructed of a pair of angle members 130 and 132 and having a cross section as shown best in FIG. 14.

Angle members 136 are secured over the ends of the side members 122 and 124, as shown best in FIG. 14, and are welded or otherwise conveniently held in place. As shown best in FIG. 14, the end members 126 and 128 are then secured to the angle members 136 by convenient means, such as rivets 138.

The rectangular portion of the carriage 120 then further includes the lighter gauge metal finishing angles 140, 142, 144, and 146 extending around the entire perimeter and over the top thereof, as shown best in FIGS. 13, 14, and 15, which are secured to the side members 122 and 124 and end members 126 and 128 by convenient means such as welding, screws and the like.

In addition, the angle members 148, 150, 152, and 154 are provided at the corners of the carriages 120, and extend above the members 140, 142, 144, and 46 to insure the storage unit parts placed on the carriages 120 are held in a secure position on the carriages 120. The angle members 148, 150, 152, and 154 are secured in place on the corners of the carriage 120 by convenient means, not shown.

As shown best in FIGS. 14 and 15, the guide assemblies 110 include a headed spindle 158 extending downwardly through openings 160 and 162 in the ends of the side members 122 and 124 and the angle members 136. A spacer 164 is sleeved over the spindle 158. A guide roller 166 is also sleeved over the spindle 158. The spindle 158 is held in position with the spacer 164 and guide roller 166 thereon by a C-ring 168. As shown, the guide roller 166 is positioned in the guide channel 108 in assembly of the carriage 120 with the track 100.

The wheel assembly 106 shown in FIG. 14 includes the wheel 170 supported for rotation about the axis 174 of axle 176 by bearing means 178. Axle 176 is secured to the end member 128 at one end thereof by passing through aligned openings 180 and 182 therein, and is locked in position by the C-rings 184 and 186 positioned in the annular grooves 188 and 190 in the axle 176. As shown best in FIG. 14, the wheel 170 rests on the rail 104.

The wheel assemblies 106 are provided at each end of the end member 128 over the rail 104. Guide assemblies 110 are provided at the associated ends of the side members 120 and 122.

Similar wheel assemblies 130 and 132 are provided at the ends of the other end member 126 in parallel spaced apart relation to the track 100. The size of the wheels and the vertical location of the axles of the wheel assemblies 130 and 132 are chosen such that when the carriage 120 is level, the wheels of the wheel assemblies 130 and 132 are resting on the floor in spaced apart relation to the track 100 and the wheels such as wheel 170 are positioned on the rail 104.

Figure 20:
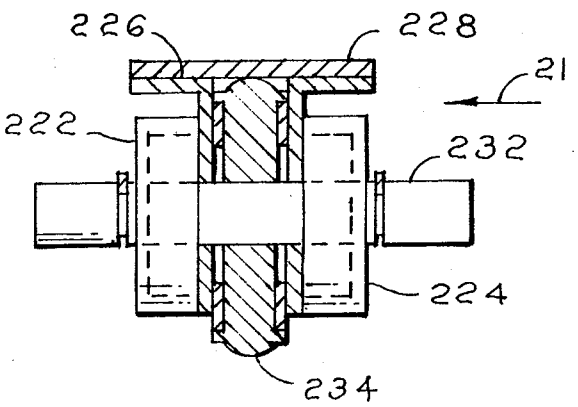
FIG. 20 is an enlarged section view of still another wheel assembly for use in the carriage structure illustrated in FIG. 13, taken on line 20—20 in FIG. 21.
Figure 21:
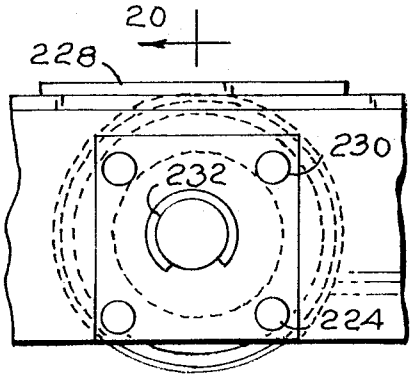
FIG. 21 is an elevation view of the wheel assembly illustrated in FIG. 20, taken substantially in the direction of arrow 21 in FIG. 20.
Figure 18:
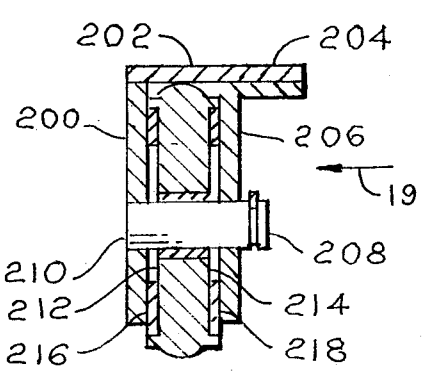
FIG. 18 is an enlarged cross section view of another wheel assembly for use in the carriage structure illustrated in FIG. 13, taken on the line 18—18 in FIG. 19.
Figure 19:
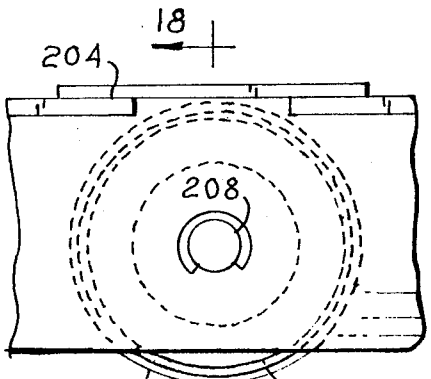
FIG. 19 is an elevation view of the wheel assembly illustrated in FIG. 18, taken substantially in the direction of arrow 19 in FIG. 18.

Further, as shown in FIGS. 18, 19, 20, and 21, all of the wheel assemblies may be modified in accordance with the weight it is desired to support on an individual storage unit. Thus, the wheel assembly as shown in FIGS. 14, 15, 16, and 17 is adequate for supporting weights of, for example, up to approximately 500 pounds. With heavier loads, such as 1000 pounds, a wheel assembly such as shown in FIGS. 18 and 19 is desirable. Still heavier loads, of for example 2000 pounds, may require a wheel assembly as shown in FIGS. 20 and 21.

Figure 16:
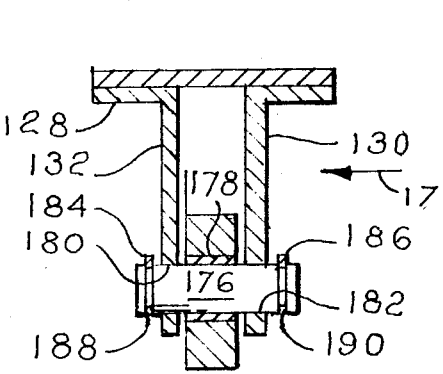
FIG. 16 is an enlarged cross section view of a wheel assembly for use in the carriage structure illustrated in FIG. 13, taken on the line 16—16 in FIG. 17.
Figure 17:
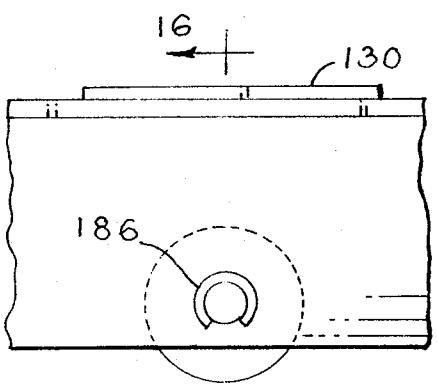
FIG. 17 is an elevation view of the wheel assembly illustrated in FIG. 16, taken substantially in the direction of arrow 17 in FIG. 16.

The wheel assembly of FIGS. 18 and 19 differs from that shown in FIGS. 16 and 17 in that the angles member 200 has a horizontal portion 202 which extends in the same direction as the horizontal portion 204 of the angle member 206. Also, the axle 208 is secured to the angle member 200 at the end 210. Further, the wheel 220 has disc shaped recesses 212 and 214 in the opposite sides thereof. Lubricating members 216 and 218 are positioned within the recesses 212 and 214 between the angle members 200 and 206 and the wheel 220. Further, the lubricating members 216 and 218 are annular, and have an internal diameter considerably larger than the diameter of the axle 208. Such structure is advantageous in that it permits freer movement of the wheel 220 and thus the individual storage units without the expense that would be incurred with lubricating members 216 and 218 which were complete discs or discs having internal diameters only large enough to permit the axle 208 to extend therethrough.

The embodiment of the wheel assembly shown in FIG. 20 is similar to the wheel assembly shown in FIGS. 16 and 18; however, bearing structures 222 and 224 are provided on the outside of the angle members 226 and 228, and are secured thereto by convenient means such as bolts 230. The larger bearing structures 222 and 224 permit greater loads to be placed on the axle 232 without inhibiting rolling of the wheel 234.

In accordance with the method of the invention, the compact mobile storage system of the invention is installed by placing a single track on the floor, constructing the carriages 120 as shown best in FIG. 13 to include the guide assemblies and wheel assemblies such as guide assembly 110 and wheel assembly 106, and positioning the carriages and storage structure positioned on top of the carriage on the single track 100.

As considered above, utilizing a single track with a mobile storage system reduces the cost of the mobile storage system. It further reduces the tripping hazard associated with a second track at the front of the individual storage units. Cleaning of the area around the individual storage units is further facilitated due to the elimination of the second track.

Figure 12:
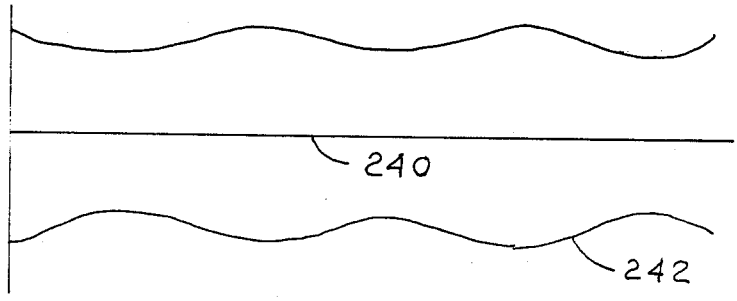
FIG. 12 is a diagram useful in explaining the operation of the mobile storage system constructed in accordance with the invention for practicing the method of the invention.

In addition, in accordance with the invention, with the track installed level as indicated by line 240 in FIG. 12, and with the carriages 120 sufficiently flexible so that they will flex slightly so as to be articulate under the loads which they are designed to support, drift of the individual storage units is inhibited. That is to say, the individual storage units will not have a tendency to move toward low areas of the floor, which is uneven, as shown by line 242 in FIG. 12, on which the track in installed.

Further, compensation for drift may be enhanced by adjusting the track 100 with the adjusting screws 112 to have a slope opposite the slope of the floor at the opposite edge of the individual storage unit, as shown by line 244 in FIG. 12. Thus, when the floor slopes down, the track will slope up so that one end of the individual storage unit will tend to be urged uphill at the same time the other end of the storage unit is urged downhill, resulting in theoretical elimination of drift, and in practice a great reduction of unwanted drift of individual storage units.

The compensation for drift of individual storage units with inexpensive structure as proposed herein is particularly desirable in all installations, and is essential in installation wherein users of the storage systems have a tendency towards claustrophobia and the movement of a storage unit without intention can create panic.

Also, while specific structure for effecting movement of the individual and connected storage units, such as handles 45 for manual movement of the storage units as shown in FIG. 4 and mechanical means 25 for assisted manual movement of the storage units as shown in FIG. 1, have not been considered in detail, it will be understood that all convenient structures for and methods of movement of storage units of existing compact mobile storage systems are suitable for use in conjunction with the single track, compact mobile storage system of the invention. Thus, for example, manual, mechanically assisted and automatic systems, such as electrical systems, for movement of the storage units are contemplated.

While one embodiment of the present invention has been considered in detail along with modifications thereof, it will be understood that other embodiments and modifications of the invention are contemplated. It is the intention to include all embodiments and modifications as are defined by the appended claims within the scope of the invention.

I claim:

1. A compact storage system comprising only a single track, a plurality of separate storage units, each including spaced apart wheels, at least some of which are positioned in engagement with the single track, means separate from the wheels and single track operable between the single track and storage units for guiding the storage units supported on the wheels for movement along the single track and means operably associated with the track and storage units compensating for drift of the separate storage units comprising means installing the track with a predetermined slope other than 0°.

2. Structure as set forth in claim 1 wherein the track is installed on a floor having a slope in one direction at a location in predetermined spaced apart relation to the track and wherein the means compensating for drift of the separate storage units comprises means installing the track with a slope equal to and in the opposite direction to the slope of the floor on which the track is installed at the location in predetermined spaced relation to the track.

3. A mobile storage system comprising a plurality of separate storage units, wheel assemblies for supporting the storage units connected to the storage units, at least one track with which the wheel assemblies are associated for guiding the separate storage units on movement of the separate storage units, and means operably associated with the tracks and storage units compensating the mobile storage systems for drift of the separate storage units along the track including means installing the one track with a predetermined slope other than 0°.

4. Structure as set forth in claim 3 wherein the track is installed on a floor having a slope in one direction at a location in predetermined spaced relation to the track and wherein the means compensating the mobile storage system for drift includes means for installing the one track with a slope in the opposite direction to the slope of the floor on which the one track is installed at the location in predetermined spaced relation to the track.

5. The method of supporting and guiding a plurality of separate storage units of a compact mobile storage system on a floor including providing only a single track having separate rail and guide portions, installing the single track on the floor, installing a wheel and guide roller on the separate storage units at one end thereof and placing them on the rail portion and in the guide portion of the single track respectively, providing at least one wheel on the outer edge of the storage unit in spaced relation to the track, supporting the one wheel directly on the floor and compensating the separate storage units for drift including installing the single track with a predetermined slope other than 0°.

6. The method as set forth in claim 5 wherein the step of compensating the separate storage units for drift includes installing the single track to have a slope equal to and opposite the slope of the floor at the edge of the separate storage units opposite the single track.

7. The method of installing a compact mobile storage system on a floor having a slope comprising installing guide means for a plurality of separate storage units and compensating for drift of the separate storage units of the mobile storage system including the step of installing the single track with a predetermined slope other than 0°.

8. The method as set forth in claim 7 wherein compensating for drift of the separate storage units includes adjusting the slope of the single track so that it is in the opposite direction to the slope of the floor at the opposite edge of the separate storage units.

* * * * *